US005230780A

United States Patent [19]

Carlson et al.

[11] Patent Number: 5,230,780

[45] Date of Patent: Jul. 27, 1993

[54] ELECTROLYZING HALOGEN-CONTAINING SOLUTION IN A MEMBRANE CELL

[75] Inventors: Richard C. Carlson, Euclid; Kenneth L. Hardee, Middlefield, both of Ohio

[73] Assignee: Eltech Systems Corporation, Del.

[21] Appl. No.: 838,982

[22] Filed: Feb. 21, 1992

Related U.S. Application Data

[63] Continuation of Ser. No. 447,775, Dec. 8, 1989, abandoned.

[51] Int. Cl.[5] ..... C25B 1/16

[52] U.S. Cl. ..... 204/98; 204/128

[58] Field of Search ..... 204/98, 128, 290 R, 204/290 F, 291; 502/326, 350; 428/639, 660, 670, 469

[56] References Cited

U.S. PATENT DOCUMENTS

| | | | |
|---|---|---|---|
| 3,632,498 | 1/1972 | Beer | 204/290 F |
| 3,645,862 | 2/1972 | Cotton et al. | 204/56 R |
| 3,711,385 | 6/1973 | Beer | 204/59 |
| 3,948,751 | 4/1976 | Bianchi et al. | 204/290 F |
| 4,005,004 | 1/1977 | Seko et al. | 204/290 F |
| 4,457,824 | 7/1984 | Dempsey et al. | 204/290 F |
| 4,565,434 | 1/1986 | Busse-Machukas et al. | 204/290 F |

FOREIGN PATENT DOCUMENTS 1147441 4/1969 United Kingdom .

*Primary Examiner*—John Niebling
*Assistant Examiner*—Kathryn Gorgos
*Attorney, Agent, or Firm*—John J. Freer

[57] ABSTRACT

A coating is now disclosed which is especially serviceable as an improved electrocatalytic coating for an electrode. The coating is a crystalline coating of mixed oxides. The oxides are of iridium, ruthenium and titanium, in very specially defined proportions. When the coating is present on an electrically conductive metal substrate that can serve as an electrode, such electrode has, in combination, the characteristics of reduced oxygen evolution in a membrane cell, low chlorine electrode potentials, plus reduced coating weight loss in a caustic environment.

3 Claims, No Drawings

ELECTROLYZING HALOGEN-CONTAINING SOLUTION IN A MEMBRANE CELL

This is a continuation of application Ser. No. 07/447,775, filed Dec. 8, 1989, now abandoned.

BACKGROUND OF THE INVENTION

Electrodes for use in electrolytic processes have been known which have a base or core metal bearing a layer or coating of metal oxides. The core metal of the electrode may be a valve metal such as titanium, tantalum, zirconium, niobium or tungsten. Where the coating is an oxide mixture, an oxide of the core or substrate metal can contribute to the mixture. As taught for example in U.S. Pat. No. 3,711,385, such mixture can include an oxide of the substrate metal plus at least one oxide of a metal such as platinum, iridium, rhodium, palladium, ruthenium, and osmium.

It has also been known that such mixture which can be termed a noble metal oxide mixture, can be a mixture of ruthenium oxide and iridium oxide. Such have been taught generally in U.S. Pat. No. 3,632,498 and examples shown specifically, when combined with titanium oxide, in U.S. Pat. No. 3,948,751. Particularly for utilization as a coating on an electrode used in an electrolysis of an aqueous alkali-metal halide, e.g., sodium chloride, it has been taught in U.S. Pat. No. 4,005,004 that such noble metal oxide mixture can be particularly serviceable when in further mixture with both titanium oxide and zirconium The invention is broadly directed to an electrode having reduced oxygen evolution during electrolysis of halogen-containing solutions particularly at low pH, such electrode comprising an electrically conductive metal substrate having a coating of enhanced stability under alkaline conditions, which coating comprises at least 15, but less than 25, mole percent iridium oxide, 35–50 mole percent ruthenium oxide and at least 30, but less than 45 mole percent titanium oxide basis 100 mole percent of the oxides present in the coating. Thereby the coating has a molar ratio of titanium oxide to the total of the oxides of iridium and ruthenium of less than 1:1, and should have a molar ratio of ruthenium oxide to iridium oxide of greater than 1.5:1 and up to 3:1.

In another aspect, the invention is directed to a coating composition adapted for providing the foregoing described mixed metal oxide coating and in a still further aspect is directed to the method of making an electrode which is hereinbefore defined. The electrode will be particularly useful as an anode in a membrane cell used for the electrolysis of brine that is at a pH within the range of from about 2 to about 4.

DESCRIPTION OF THE PREFERRED EMBODIMENTS

The coating composition of the present invention is broadly applicable to any electrically conductive metal substrate which will be sufficiently electrically conductive to serve as an electrode in an electrolysis process. Thus, the metals of the substrate are broadly contemplated, but in view of the application of an electrocatalytic coating, the substrate metals more typically may be such as nickel or manganese, or most always the valve metals, including titanium, tantalum, aluminum, tungsten, zirconium and niobium. Of particular interest for its ruggedness, corrosion resistance and availability is titanium. As well as the normally available elemental metals themselves, the suitable metals of the substrate can include metal alloys and intermetallic mixtures. For example, titanium may generally be alloyed with nickel, cobalt, iron, manganese or copper. More specifically, Grade 5 titanium may include up to 6.75 weight % aluminum and 4.5 weight % vanadium, grade 6 up to 6% aluminum and 3% tin, grade 7 up to 0.25 weight % palladium, grade 10, from 10 to 13 weight % molybdenum plus 4.5 to 7.5 weight % zirconium and so on.

The coating composition applied to the coated metal substrate will be aqueous, which will most always be simply water without any blending with further liquid. Preferably, deionized or distilled water is used to avoid inorganic impurities. For economy of preparation and utilization, the aqueous compositions that are serviceable will be solutions of precursor constituents in the aqueous medium, that is, precursors to the oxides that will be present in the coating. The precursor constituents utilized in the aqueous solution are those which can be solubilized in water efficiently and economically, e.g., achieve solution without extensive boiling condition. Moreover, the precursors must supply the respective metal oxide on thermodecomposition. Where they are all present in the same composition, they must also be compatible with one another. In this regard, they are advantageously non-reactive toward one another, e.g., will not react so as to form products which will lead to deleterious non-oxide substituents in the coating or precipitate from the coating solution. Usually, each precursor constituent will be a metal salt that most often is a halide salt and preferably for economy coupled with efficiency of solution preparation such will all be the chloride salt. However, other useful salts include iodides, bromides and ammonium chloro salts such as ammonium hexachloro iridate or ruthenate.

In the individual or combination solutions, in addition to the suitable precursor constituent, most always with only one exception no further solution ingredients will be present. Such exception will virtually always be the presence of inorganic acid. For example, a solution of iridium trichloride can further contain strong acid, most always hydrochloric acid, which will usually be present in an amount to supply about 5 to 20 weight percent acid. Typically, the individual or combination solutions will have a pH of less than 1, such as within the range of from about 0.2 to about 0.8.

When the coating composition is a solution of all precursor constituents, such will contain at least 15, but less than 25, mole percent of the iridium constituent, 35–50 mole percent of the ruthenium constituent, and at least 30, but less than 45, mole percent of the titanium constituent, basis 100 mole percent of these constituents. A composition containing an iridium constituent in an amount of less than 15 mole percent will be inadequate for providing an electrode coating having the best caustic stability, such as when the electrode is used in a chlor-alkali cell. On the other hand, less than 25 mole percent for the iridium precursor will be desirable for best low operating potential efficiency for the coating. In regard to the ruthenium, a constituent amount in the solution of less than about 35 mole percent will be insufficient to provide the most efficient low chlorine potential for resulting coatings, while an amount not greater than 50 mole percent enhances coating stability. Also, for best coating characteristics, the molar ratio of ruthenium oxide to iridium oxide in the resulting coating will be from greater than 1.5:1 up to 3:1.

For the titanium precursor in the coating composition, an amount providing less than 30 mole percent titanium is uneconomical while 45 mole percent titanium or more can lead to higher operating potential for electrode coatings operating in chlor-alkali cells. Preferably for best economy, coupled with the overall most desirable coating characteristics, the coating solution will contain constituents in a proportion such as to provide from about 18–22 mole percent iridium, 35–40 mole percent ruthenium, and 40–44 mole percent titanium. The resulting coating will furthermore have a molar ratio of titanium oxide to the total of the oxides of iridium ruthenium of less than 1:1, but most always above 0.5:1.

Before applying the coating composition to the substrate metal, the substrate metal advantageously is a cleaned surface. This may be obtained by any of the treatments used to achieve a clean metal surface, including mechanical cleaning. The usual cleaning procedures of degreasing, either chemical or electrolytic, or other chemical cleaning operation may also be used to advantage. Where the substrate preparation includes annealing, and the metal is grade 1 titanium, the titanium can be annealed at a temperature of at least about 450° C. for a time of at least about 15 minutes, but most often a more elevated annealing temperature, e.g., 600°–875° C. is advantageous.

After the foregoing operation, e.g., cleaning, or cleaning and annealing, and including any desirable rinsing and drying steps, the metal surface is then ready for continuing operation. Where such is etching, it will be with an active etch solution. Typical etch solutions are acid solutions. These can be provided by hydrochloric, sulfuric, perchloric, nitric, oxalic, tartaric, and phosphoric acids as well as mixtures thereof, e.g., aqua regia. Other etchants that may be utilized include caustic etchants such as a solution of potassium hydroxide/hydrogen peroxide in combination, or a melt of potassium hydroxide with potassium nitrate. For efficiency of operation, the etch solution is advantageously a strong, or concentrated, aqueous solution, such as an 18–22 weight % solution of hydrochloric acid, or a solution of sulfuric acid. Moreover, the solution is advantageously maintained during etching at elevated temperature such as at 80° C. or more for aqueous solutions, and often at or near boiling condition or greater, e.g., under refluxing condition. Preferably, the etching will prepare a roughened surface, as determined by aided, visual inspection. Following etching, the etched metal surface can then be subjected to rinsing and drying steps to prepare the surface for coating.

The coating composition can then be applied to the metal substrate by any means for typically applying an aqueous coating composition to a substrate metal. Such methods of application include brush, roller, and spray application. Moreover, combination techniques can be utilized, e.g., spray and brush technique. Spray application can be either conventional compressed gas or can be electrostatic spray application. Advantageously, electrostatic spray application will be used for best wrap around affect of the spray for coating the back side of an article such as a mesh electrode.

Following application of the coating, the applied composition will be heated to prepare the resulting mixed oxide coating by thermodecomposition of the precursors present in the coating composition. This prepares the mixed oxide coating containing the mixed oxides in the molar proportions as above discussed. Such heating for the thermodecomposition will be conducted at a temperature of at least about 440° C. peak metal temperature for a time of at least about 3 minutes. More typically the applied coating will be heated at a more elevated temperature for a slightly longer time, but usually a temperature of greater than about 550° C. is avoided for economy and to avoid detrimental effects on anode potential where the coated metal will serve as an anode. Suitable conditions can include heating in air or oxygen. Following such heating, and before additional coating as where an additional application of the coating composition will be applied, the heated and coated substrate will usually be permitted to cool to at least substantially ambient temperature. The resulting finished coating has a smooth appearance to the unaided eye, but under microscopic examination is seen to be nonhomogeneous, having embedded crystallites in the field of the coating. Although the application of coating compositions other than as disclosed herein is then contemplated, for best overall performance of the coated substrate metal as an electrode, subsequently applied coatings will be of those compositions of the invention disclosed herein.

The following example shows a way in which the invention has been practiced, but should not be construed as limiting the invention.

EXAMPLE

A coating solution was prepared by combining 157 gms of iridium, using a solution of iridium trichloride in 18% by weight HCl, 144 gms of ruthenium, using a solution of ruthenium trichloride in 18% by weight HCl, 80 gms of titanium, using titanium tetrachloride in 10% by weight HCl solution, 331 gms HCl, using 36 weight % solution, then diluting to 10 liters with deionized water. This provided a coating composition having 21 mole % iridium; 36.3 mole % ruthenium, and 42.7 mole % titanium. Four liters of 93 grams per liter (gpl) HCl solution were then added to make the final coating solution.

This solution was applied using a hand roller to a titanium mesh substrate having a diamond-patterned mesh, with each diamond pattern having about 8 millimeters (mms.) long way of design plus about 4 mms. short way of design. The titanium mesh had been annealed at 600° C. for 30 minutes and etched in 25 wt % sulfuric acid at 85°–90° C., then water rinsed and air dried. The applied coating was air dried then baked at 470° C. Eighteen (18) coats were applied in this manner. After the final coat, the anode was postbaked at 525° C. for 4 hours.

Operation of eight samples of the resulting coated titanium substrate, when utilized as an anode in 12 normal NaOH at 95° C. for 4 hours at 25 kA/m$^2$ resulted in an average weight loss of 5.27 gm/m$^2$. Use of a sample as an anode in a chlor-alkali membrane cell operating at 3.3 kA/m$^2$ resulted in 0.06%, 0.22%, and 0.38%, by volume, oxygen produced in the chlorine cell product at an electrolyte pH of 2, 3 and 4, respectively. The operating potential of this anode in the membrane cell was 1.09 volts vs. a standard calomel reference electrode.

The average caustic weight loss of 5.27 gm/m$^2$ was especially noteworthy since a comparative coating having 7.8 mole percent iridium oxide, 15 mole percent ruthenium oxide and 77.2 mole percent titanium oxide exhibited such weight loss of 8.9 gm/m$^2$ when tested under the same conditions. Moreover, again comparatively, but as the mole percent changed to more closely approach the invention composition, but still in a comparative coating, the caustic weight loss increased to 19.2 gm/m$^2$.

What is claimed is:

1. An electrolytic membrane process for electrolyzing a halogen-containing solution in an electrolytic membrane cell comprising at least one anode, with there being reduced oxygen evolution during said electrolysis, which process comprises:

establishing in said cell a halogen containing electrolyte;

providing an anode having a mixed oxide coating consisting of constituents in an amount of at least 15, but less than 25 mole percent iridium oxide, 35–50 mole percent ruthenium oxide and at least 30, but less than 45, mole percent titanium oxide, basis 100 mole percent of these oxides present in the coating, whereby the coating has a molar ratio of titanium oxide to the sum of the oxides of iridium and ruthenium of less than 1:1, with the molar ratio of ruthenium oxide to iridium oxide being from greater than 1.5:1 and up to 3:1;

impressing an electric current on said anode; and conducting the electrolysis of said halogen-containing solution at a pH within the range of from about 2 to about 4.

2. The method of claim 1, wherein said anode has said mixed oxide coating on an electrically conductive metal substrate.

3. The method of claim 1, wherein said electrically conductive metal substrate is titanium and said coating is provided on said titanium substrate by procedure including electrostatic spray application.

* * * * *